US010309058B2

(12) United States Patent
Haddock et al.

(10) Patent No.: US 10,309,058 B2
(45) Date of Patent: Jun. 4, 2019

(54) PAPER TRIM CUT MEASUREMENT DEVICE AND METHOD

(71) Applicant: INTERNATIONAL PAPER COMPANY, Memphis, TN (US)

(72) Inventors: Jeremy Allan Haddock, Leland, NC (US); Ronald Arthur Falcone, Jr., Wilmington, NC (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 72 days.

(21) Appl. No.: 14/949,209

(22) Filed: Nov. 23, 2015

(65) Prior Publication Data

US 2016/0177509 A1 Jun. 23, 2016

Related U.S. Application Data

(60) Provisional application No. 62/084,678, filed on Nov. 26, 2014.

(51) Int. Cl.

| | |
|---|---|
| ***D21F 7/00*** | (2006.01) |
| ***D21F 9/02*** | (2006.01) |
| ***D21F 2/00*** | (2006.01) |
| ***D21G 9/00*** | (2006.01) |

(52) U.S. Cl.

CPC ..... *D21F 7/006* (2013.01); *D21F 2/00* (2013.01); *D21F 9/02* (2013.01); *D21G 9/0027* (2013.01)

(58) Field of Classification Search

CPC ... D21F 7/00; D21F 7/006; D21F 2/00; D21F 9/02; D21G 9/00; D21G 9/0027; B26F 1/26; B26F 3/00; B25F 3/004

See application file for complete search history.

(56) References Cited

U.S. PATENT DOCUMENTS

| | | | | |
|---|---|---|---|---|
| 2,806,492 | A | 9/1957 | Becker | |
| 4,503,740 | A * | 3/1985 | Brand | B23D 33/12 83/520 |
| 4,885,967 | A | 12/1989 | Bell et al. | |
| 5,068,513 | A * | 11/1991 | Gangemi | B26F 3/004 219/121.67 |
| 5,505,129 | A * | 4/1996 | Greb | B65H 23/0216 101/151 |
| 5,673,492 | A | 10/1997 | Williams | |
| 5,918,523 | A | 7/1999 | Cutter | |
| 6,073,621 | A | 6/2000 | Cetrangolo | |
| 6,539,638 | B1 | 4/2003 | Pelletier | |
| 6,644,156 | B2 | 11/2003 | Villacis | |
| 6,976,764 | B2 | 12/2005 | Cheng et al. | |

(Continued)

FOREIGN PATENT DOCUMENTS

| | | |
|---|---|---|
| DE | 10317721 | 11/2004 |
| WO | 2007088243 | 8/2007 |

*Primary Examiner* — Dennis R Cordray

(74) *Attorney, Agent, or Firm* — David B. Poe; Thomas W. Barnes, III

(57) ABSTRACT

One embodiment provides a papermaking machine, which includes a wire for conveying a fiber web; a trim squirt for making a cut line in the fiber web; a machine reference; and a measurement device for measuring a distance between the cut line and the machine reference, the device comprising a laser adapted to illuminate the cut line and determine a location of the cut line for the measuring. Methods of making and using the papermaking machine are also provided.

16 Claims, 13 Drawing Sheets

(56) References Cited

U.S. PATENT DOCUMENTS

| | | | |
|---|---|---|---|
| 7,024,791 | B2 | 4/2006 | Marshall et al. |
| 7,073,268 | B1 | 7/2006 | Etter et al. |
| 7,121,010 | B2 | 10/2006 | Marshall et al. |
| 7,162,809 | B2 | 1/2007 | Haas et al. |
| 7,219,437 | B2 | 5/2007 | Dallman |
| 7,353,612 | B1 | 4/2008 | Wygle et al. |
| 7,398,719 | B2 | 7/2008 | Peot et al. |
| 7,430,810 | B2 | 10/2008 | Sergyeyenko et al. |
| 7,434,576 | B2 | 10/2008 | Hwang |
| 7,454,840 | B2 | 11/2008 | Delfini et al. |
| 7,469,480 | B2 | 12/2008 | Nottingham et al. |
| 7,484,304 | B2 | 2/2009 | Campagna |
| 7,770,502 | B2 | 8/2010 | Parrish et al. |
| 7,926,398 | B2 | 4/2011 | Garcia et al. |
| 8,381,623 | B2 | 2/2013 | Block et al. |
| 8,536,482 | B2 | 9/2013 | Link |
| 2001/0049988 | A1 | 12/2001 | Ushiwata et al. |
| 2010/0257985 | A1 | 10/2010 | Hall |
| 2013/0145635 | A1 | 6/2013 | Dallman |

* cited by examiner

PAPER TRIM CUT MEASUREMENT DEVICE AND METHOD

CROSS-REFERENCE TO RELATED APPLICATIONS

This application claims the benefit of prior-filed U.S. provisional application No. 62/084,678, filed Nov. 26, 2014, the entire contents of which being hereby incorporated by reference.

FIELD OF THE INVENTION

The present invention relates to the papermaking industry and devices and methods used therein, and particularly those devices and methods for cutting and measuring a cellulosic web during the wet end of the papermaking process.

BACKGROUND

Optical cutting edge locators for cutting apparatus are known and increase the accuracy and efficiency of the cutting operation. U.S. Pat. No. 4,503,740 discloses one example of such an apparatus, wherein an optical beam is directed toward a workpiece to assist the operator to align the workpiece with the cutting device prior to being cut.

Other devices are known in which lasers are used to assist the operator in pre-positioning letters, characters, or other objects on the work surface. U.S. Pat. No. 7,219,437 discloses one example of such a device.

Other examples in which optical markers are employed to assist the operator in marking the workpiece prior to cutting or prior to positioning objects and the like are disclosed in U.S. Pat. Nos. 7,469,480 and 7,484,304 and U.S. Patent Publication No. 2010/0257985.

In the aforementioned examples, the optical marking is employed prior to either cutting the workpiece or positioning or affixing the object to a desired location on the workpiece.

In the papermaking industry, a papermaking furnish is applied from a headbox onto a moving wire of a fourdrinier machine, to form a fiber web. So-called "trim squirts" are used to eject high-pressure, focused, water jets toward the fiber web, which cut the fiber web leaving a smooth edge. The thus-cut trim sections are separated from the fiber web, and the remaining fiber web undergoes further processing into a paper product. Operators can adjust the water jet equipment, for example, to modify the width of the fiber web. It is very difficult, however, to accurately cut the fiber web with the trim squirts such that the width of the fiber web and its position relative to the cross direction of the wire are accurately known. The trim squirts may get knocked out of line or be subject to changes or degradation in the nozzle, water pressure, and the like, which affects the cut location relative to the nozzle position. Efforts have been made to improve the trim squirts, such as making them adjustable, more operationally durable, etc., but despite these efforts, the present inventors have found that it is difficult to reliably coordinate the cut location in the fiber web with the position of the trim squirt nozzle. Heretofore, to compensate for the variability in the trim squirt position, operators typically held a standard tape measure over the moving web to measure the distance between a fixed reference on the machine and the trim cut or cut line. In practice, and under typical operating conditions, this method of measuring results in an estimate of the measurement and is dependent on the individual judgment of the particular operator taking the reading. This method is satisfactory on conventional papermaking machines using conventional headbox technology, e.g., air-padded headboxes.

As paper machines around the world upgrade to hydraulic headbox technology, the ability to reduce the product's weight variability in the cross direction of the papermaking machine has increased as a result of increasing the amount of dilution actuators across the machine. In the hydraulic headbox, dilution actuators are mapped to corresponding positions on the corresponding product weight scanner.

The inventors have found that as the number of weight measurement zones in the product weight scanner increases, the need for precise trim squirt positions (given by trim measurements) used in the dilution actuator to corresponding weight mapping and other mapping has become a critical-to-operate measurement. The inventors have found that conventional methods of locating and measuring trim cut positions are unsatisfactory and unsuited for use with new papermaking technologies, such as the new hydraulic headboxes, weight-zone mapping, and the like.

BRIEF DESCRIPTION OF THE SEVERAL EMBODIMENTS

Figure 1:
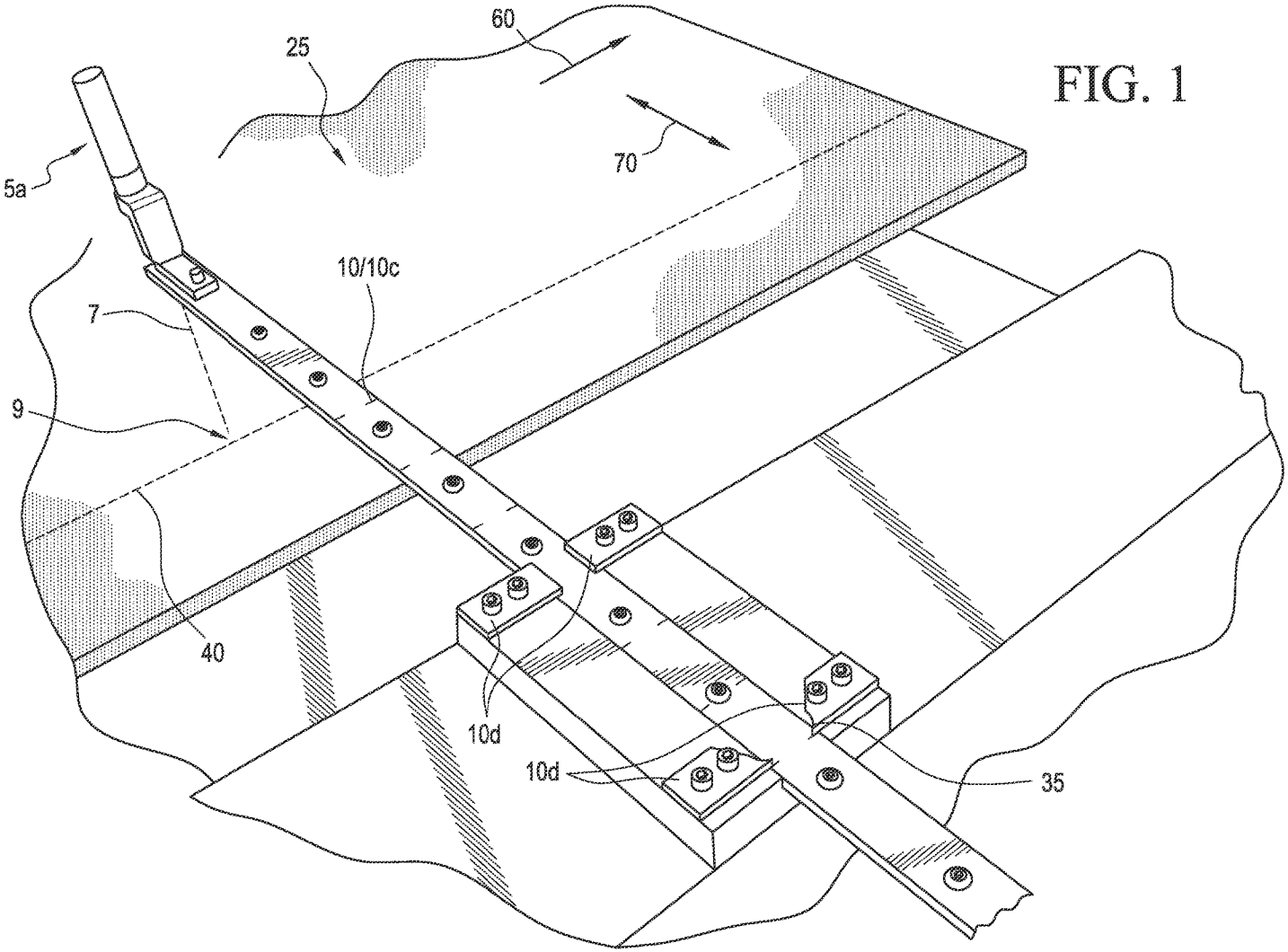
FIG. 1 shows a perspective view of one embodiment of the measurement device installed on a papermaking machine.

The present inventors have found that with the introduction of new dilution style or hydraulic headboxes and other new technologies in papermaking, the cross-direction mapping of the headbox dilution actuators to the quality measurement scanner's data boxes has become critical to cross-directional weight profile control performance. On the fourdrinier, the rough edges of the fiber web are cut using a water jet and separated (as trim) from the main fiber web; and the amount removed must be accounted for in order for the cross-directional map to be aligned and accurate.

The inventors have found that inputting an accurate measurement of sheet trim relative to a fixed reference into feedback control systems used for headbox dilution actuator positioning is required to map the effect of each actuator to the corresponding weight measurements in the product weight scanner. The inventors have found that as the number of weight zone actuators across a hydraulic headbox increases, the need for precise trim squirt positions (given by trim measurement) has become a critical-to-operate measurement. The higher the number of actuators (and therefore the more narrow the dilution actuator zone is), the greater the degradation of feedback control performance is due to inaccuracies in trim measurement.

The inventors have found that unless an accurate and defined "starting point" is determined for measuring the distance between the cut line and a fixed machine reference, it is extremely difficult to obtain a good measurement. Prior to the present invention, operators used a standard tape measure or a ruler to measure from a fixed reference point on the papermaking machine, e.g, the machine reference, to their judged "trim cut" location. The inventors have found that it is nearly impossible to align the end of the tape measure or ruler with the trim cut position: the tape measure or ruler tip can be as much as ten inches above the trim cut and as far as two feet from the operator. If one asked ten operators to take the trim position measurement, one would typically receive ten different measurements, ranging as much as ±0.5" from one another. In papermaking applications using new hydraulic headbox and weight mapping technologies, the inventors have found that such a ±0.5" variance causes major complications, e.g., in the paper machine cross-direction weight control and ultimately the final product.

These and other problems have been solved by various embodiments of the present invention, which allow one to obtain a highly repeatable and accurate measurement between the cut paper media and a fixed machine reference.

In one embodiment, a device projects a precise optical mark, which is aligned with the cut line location in the fiber web downstream of the trim squirt or other cutting device. Once the optical mark is so aligned, the distance between the cut line location and the machine reference can be easily and readily determined.

One embodiment provides a papermaking machine, comprising:

a wire for conveying a fiber web;

a trim squirt for making a cut line in the fiber web;

a machine reference; and a measurement device for measuring a distance between the cut line and the machine reference, the device comprising a laser adapted to illuminate the cut line and determine a location of the cut line for the measuring.

Another embodiment provides a method for making a fiber web or paper product, comprising:

conveying a fiber web on a wire of a papermaking machine, the papermaking machine comprising a trim squirt and a machine reference;

making a cut line in the fiber web with the trim squirt;

illuminating the cut line and determining a location of the cut line with a laser; and using the location, measuring a distance between the cut line and the machine reference.

Another embodiment provides a fiber web, produced by the aforementioned method.

Another embodiment provides a paper product, produced by the aforementioned method.

Another embodiment provides a method for making the papermaking machine, which comprises affixing the measurement device to the papermaking machine.

Heretofore, in the papermaking industry, there was no satisfactory solution for obtaining precise, reliable, and repeatable trim measurements.

Certain embodiments described herein provide several advantages. For example, the need for operators to extend their bodies above or into the plane of the paper machine with the risk of slipping, losing their balance, falling, or otherwise incurring serious injury is reduced. Measurement error is significantly reduced because the reliance on the operators' subjective judgment in determining where the end of the tape measure or ruler is relative to the trim cut position is reduced or avoided completely. Consistent and repeatable measurement results can be obtained, because all operators can use the same measurement equipment and procedure to measure the trim cut distance. By resort to embodiments of the invention, it is possible to safely, consistently, and accurately measure the trim cut distance amount regardless of the person measuring the distance.

Although the present disclosure may be most advantageously applied to papermaking operations using the new weight mapping and hydraulic headbox technologies, there is no reason to limit its applicability only to those. It could also be used in traditional applications, e.g., with traditional air-padded headboxes and/or other conventional technologies, even though such technologies may not be as dependent on the accuracy of trim squirt measurements as the inventors have found the new papermaking technologies to be.

In one embodiment, the measurement device 1 includes a laser 5 adapted to illuminate the cut line 40 and determine a location of the cut line 40.

In one embodiment, the distance 3 is the distance between the location of the cut line 40 and the machine reference 35.

In one embodiment, the device 1 includes a solid, ruler-type device with a laser attached to the end.

While the accompanying drawings are not intended to be limiting, a better understanding of various embodiments may be obtained therefrom, when considered either alone or in combination with one another and/or in light of the present disclosure. The following key to the figures is provided, but is not intended to be limiting unless otherwise noted.

| | |
|---|---|
| Measurement device | 1 |
| Distance | 3 |
| Laser | 5 |
| direct | 5a |
| indirect | 5b |
| mirror | 5bb |
| Laser line | 7 |
| Laser illumination mark | 9 |
| Bar | 10 |
| machine end | 10a |
| distal end | 10b |
| rules or tick marks | 10c |
| clamp | 10d |
| Papermaking machine | 15 |
| Wire | 20 |
| Fiber web | 25 |
| Trim squirt | 30 |
| water stream or jet | 33 |
| Machine reference | 35 |
| Cut line | 40 |
| distal edge | 40a |

-continued

| | |
|---|---|
| center | 40b |
| machine edge | 40c |
| Headbox | 45 |
| headbox actuator | 45a |
| Product weight scanner | 50 |
| weight measurement zone | 50a |
| Machine direction | 60 |
| Cross direction | 70 |
| Virtual plane parallel to wire or web | 80 |
| Virtual line in virtual plane parallel to wire or web | 85 |

One embodiment is shown in FIG. 1, wherein a laser 5*a* is directly mounted to the distal end of a ruled bar 10/10*c* connected to a papermaking machine with clamps 10*d*. A machine reference 35 provides a fixed measuring point on the papermaking machine against which one of the rule marks 10*c* on bar 10 may be aligned or noted. In some embodiments, the clamps 10*d* may be loosened, and the bar 10 can be slidably moved in or out until the laser illumination mark 9 from laser line 7 lines up with the cut line 40 in fiber web 25, the fiber web 25 having been previously cut upstream, e.g., by a trim squirt (not shown) or other suitable cutting device. The arrow 60 points in the downstream machine direction, which is the direction in which the fiber web 25 moves as it runs through the papermaking machine, as is known in the papermaking arts. The cross direction 70 is perpendicular to the machine direction 60 as is also known in the art. In some embodiments, the distance between the cut line 40 and the machine reference 35 is easily determined by reading the rule mark 10*c* that align with the machine reference 35.

Figure 2:
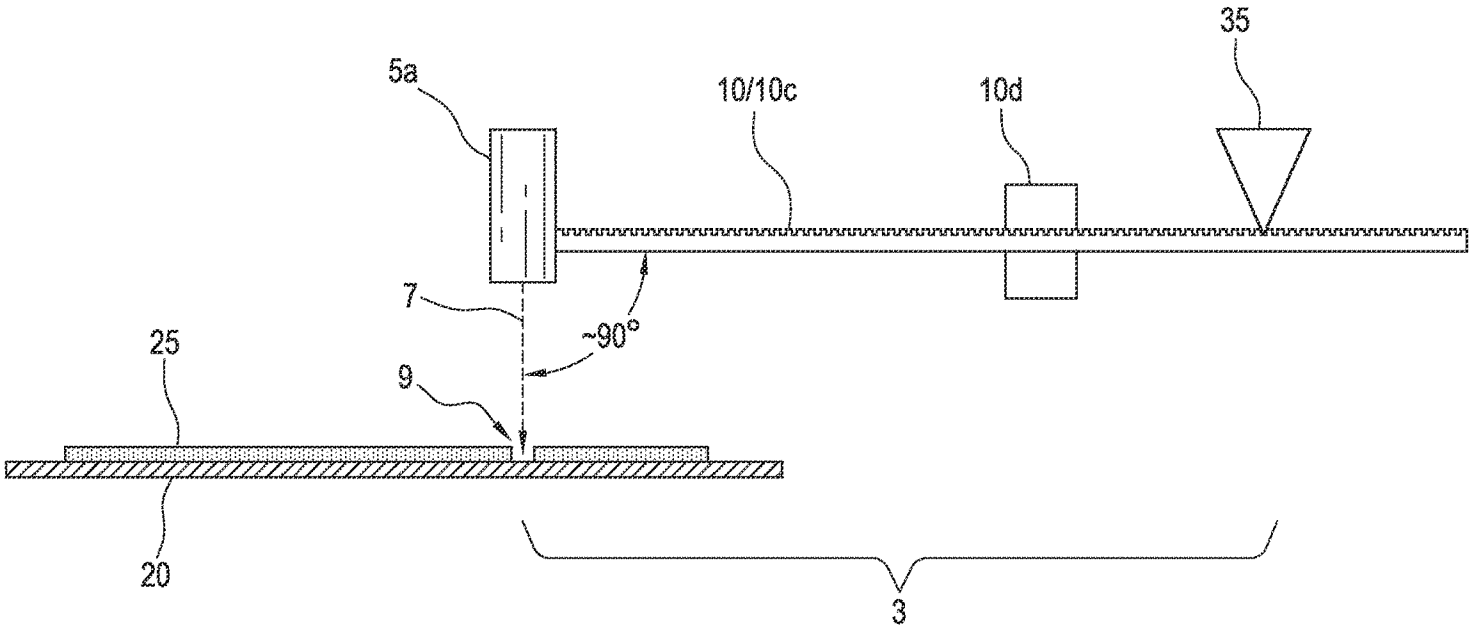
FIG. 2 shows a schematic of another embodiment, viewed along the machine direction.

FIG. 2 shows a schematic example of another embodiment of that described in FIG. 1, but viewed along the machine direction. In some embodiments, fiber web 25 is supported by wire 20; the angle (in the cross direction) between bar 10/10*c* and laser line 7 is about 90°; and the distance 3 between the cut line location (shown by laser illumination mark 9) and the machine reference 35 is illustrated.

The wire 20 is not particularly limited and may be selected from any type suitably used in the papermaking arts. Typically, the wire or "forming fabric" is a continuous belt or belts of mesh screen upon which the fiber web is formed. Non-limiting examples include fabric, synthetic fabric, continuous fabric, continuous synthetic fabric, plastic, polyester, woven polyester, monofilament, metal wire, wire mesh, bronze mesh, wire cloth, or any combination thereof. In embodiments, the wire 20 is made from a continuous synthetic fabric.

Similarly, the papermaking machine is not particularly limited, and the embodiments described herein may be suitably applied to any type of papermaking machine. Non-limiting examples include wet-laid machine, fourdrinier, top fourdrinier, duo-former, gap-former, twin wire machine, and the like. In some embodiments, the papermaking machine is one suitable for a wet-laid papermaking process. In some embodiments, the papermaking machine uses a trim squirt. In some embodiments, the papermaking machine is a fourdrinier, top fourdrinier, duo-former, gap-former, twin wire. In some embodiments, the papermaking machine is a fourdrinier machine.

The trim squirt is not particularly limiting, and any type may be suitably used. Commercial trim squirts are available, for example, from Metso, Voith, and Trim Squirt Corporation Inc., to name a few.

Figure 3:
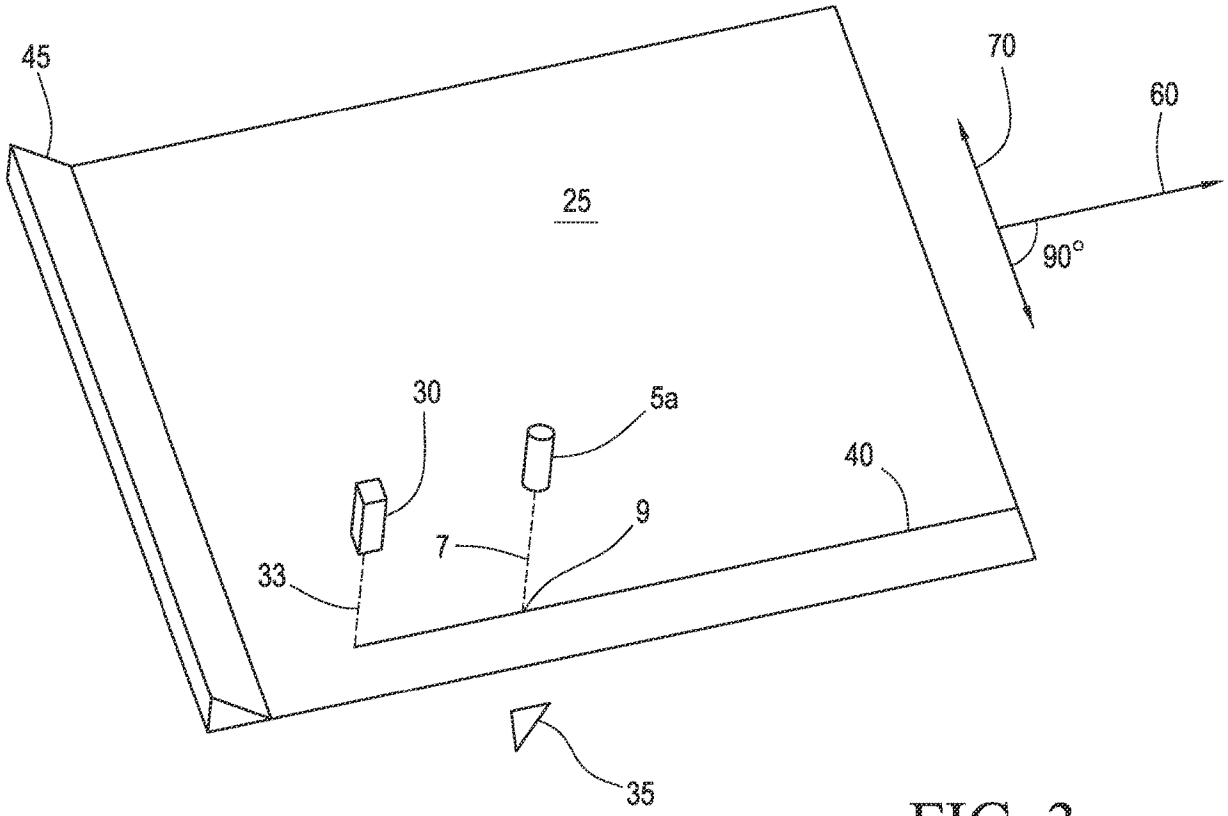
FIG. 3 shows a schematic of another embodiment, viewed in perspective.

FIG. 3 shows a schematic example of another embodiment in perspective. In the figure, a headbox 45 forms a fiber web 25, which moves along machine direction 60. A trim squirt 30 is shown, which ejects a water stream or jet 33 sufficient to cut the fiber web 25 forming a cut line 40. Downstream of the trim squirt 30, the laser 5*a* projects a laser line 7 to illuminate and determine a location of the cut line 40 via laser illumination mark 9. A machine reference 35 is shown, which is desirably fixed to the papermaking machine (not shown). In some embodiments, the machine reference 35 is aligned perpendicular to machine direction 60 and along a cross direction 70 extending from one or more of laser 5*a*, laser line 7, and/or laser illumination mark 9.

In one embodiment, the laser 5 is adapted to illuminate the cut line 40 at an angle of about 90 degrees relative to the bar 10. In some embodiments, laser 5 is adapted to illuminate the cut line 40 at an angle of about 90 degrees relative to a cross direction 70. Although 90 degrees is preferred for simplicity and ease of calculation, other angles may be used.

Figure 4:
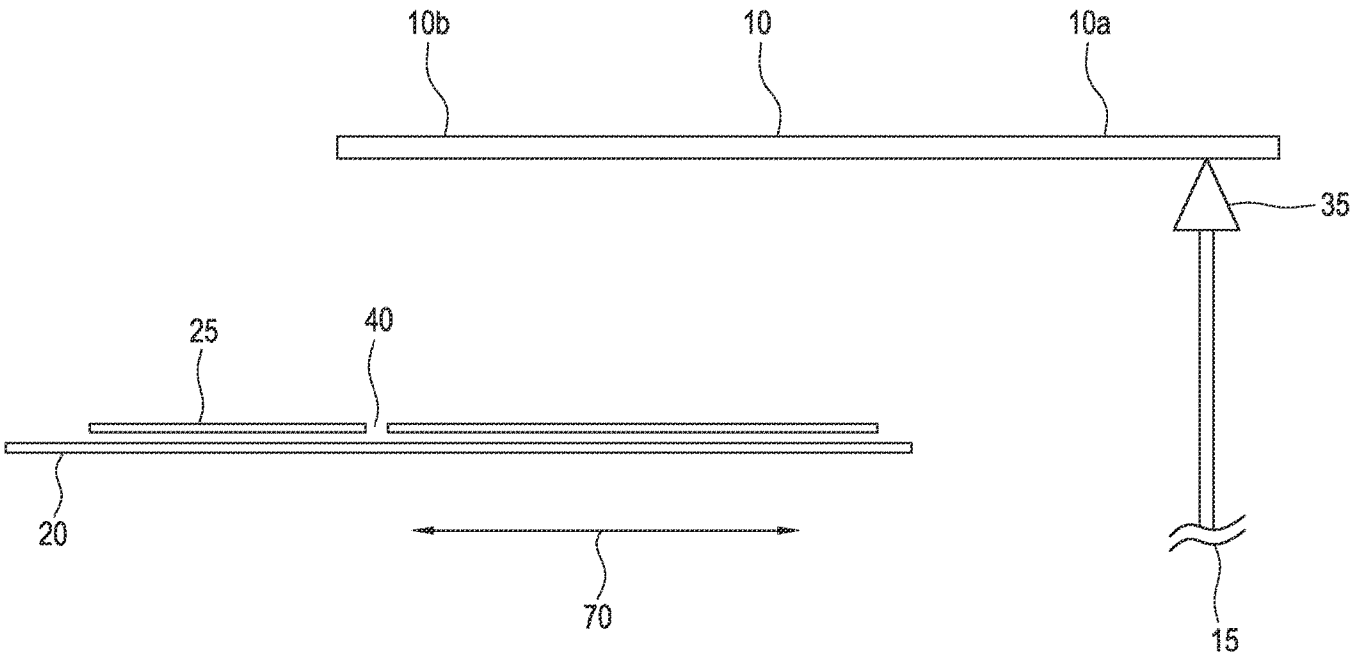
FIG. 4 shows a schematic of another embodiment, viewed along the machine direction.

FIG. 4 shows a schematic example of another embodiment, viewed along the machine direction. In this figure, one embodiment of bar 10 is shown, in which the machine end 10*a* and distal end 10*b* of the bar 10 are illustrated. Generally speaking, the distal end 10*b* extends over the fiber web 25, and the machine end 10*a* extends in a cross direction 70 toward the papermaking machine 15. Bar 10 may be connected to the papermaking machine 15 at the machine end 10*a*, or it may be connected to the papermaking machine 15 at another part of the bar. Machine reference 35 is shown attached to the papermaking machine 15. The distal end 10*b* of bar 10 may or may not be aligned over the cut line 40, and similarly, the end-most portion of bar 10 at the distal end 10*b* may or may not be aligned over the cut line 40. In one embodiment, the end-most portion of bar 10 at the distal end 10*b* is aligned over the cut line 40. In this embodiment, the laser line 7 could also be aligned with the end-most portion, for example, wherein the bar 10 is a ruled bar, e.g., a ruler having tick marks 10*c* that count from zero at the end-most portion and upward toward the machine end 10*a* of bar 10.

The bar 10 is not particularly limited, so long as it provides support for the laser 5; connects to the papermaking machine 15; and permits the laser 5 to be adjusted so that the laser illumination mark 9 can illuminate the cut line 40. The bar 10 may be a ruled bar, unruled bar, electromagnetically operated piston bar, hydraulically operated piston bar, mechanically operated piston bar, threaded bar, clamped bar, or combination of two or more thereof.

Whether solid, hollow, or a combination thereof, the bar 10 may be flat, square, rectangular, circular, triangular, or rod-like in section. If ruled, the rule marks may engage the machine reference 35 such that the rule marks 10*c* can align with and be directly read against the machine reference 35. It is contemplated that one embodiment of the machine reference 35 includes a pointer or other indicator that points to or otherwise indicates the rule mark 10*c* for the measurement.

In one embodiment, the bar 10 can be moved in a cross direction 70 such that the laser illumination mark 9 can be aligned with and illuminate the cut line 40. Moving the bar 10 may be carried out in any number of ways, such as for example by loosening clamps 10*d* that attach bar 10 to the papermaking machine 15 and sliding it in or out until the laser illumination mark 9 is aligned with and illuminates the cut line 40, wherein the clamps 10*d* may be tightened. Alternatively, the bar 10 may be moved by action of electromagnetically operated piston, hydraulically operated piston, electromechanically operated piston, mechanically operated piston, screwing in or out using threads, or any combination thereof. The bar 10 can be remotely operated in some embodiments.

In one embodiment, the machine end 10*a* is moveably attached to the papermaking machine 15, and the laser 5 is fixedly attached to the distal end 10*b*.

In another embodiment, the machine end 10*a* is fixedly attached to the papermaking machine 15, and the laser 5 is movably attached to the distal end 10*b*. In one embodiment, the bar 10 may have marks 10*c* that are reversed, e.g., wherein the "0" mark is at the machine reference 35, and the ruler counts up toward the distal end 10*b*.

In some embodiments, if electromagnetic, electromechanical, or hydraulic operation is contemplated, the machine reference 35 may be programmed into the device, control function, or the like, rather than being a physical or visual reference on the papermaking machine 15. Similarly, in some embodiments, if electromagnetic, electromechanical, or hydraulic operations are contemplated, the distance 3 can be automatically calculated, for example using a computer, calculator, control function, or the like given the machine reference 35 and upon locating the cut line 40 with the laser.

In another embodiment, the bar 10 is fixedly or moveably attached to the papermaking machine 15, and the laser 5 is fixedly or moveably attached to the distal end 10*b*.

In one embodiment, the bar 10 is moveably attached to the papermaking machine, and the laser 5*a* is fixedly attached to the distal end 10*b*.

In one embodiment, the bar 10 is a ruled bar, having rule marks or tick marks 10*c* that can be read by an operator.

Figure 5:
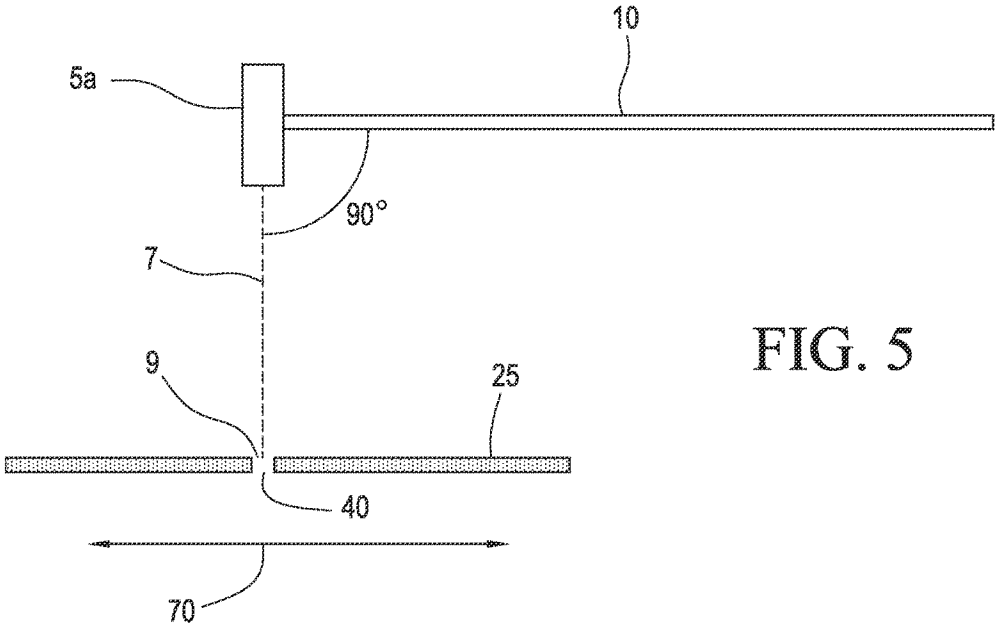
FIG. 5 shows a schematic of another embodiment, viewed along the machine direction.

FIG. 5 shows a schematic example of another embodiment, viewed along the machine direction. In this embodiment, laser 5*a* is fixedly or directly attached to bar 10. In this embodiment, the angle in the cross direction between bar 10 and laser line 7 is 90°.

Figure 6:
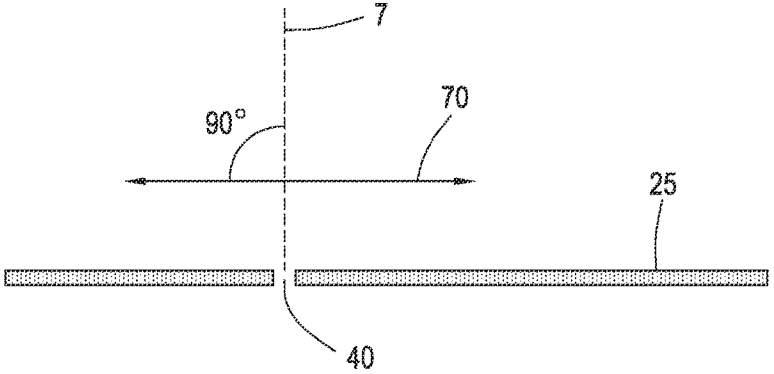
FIG. 6 shows a schematic of another embodiment, viewed along the machine direction.

FIG. 6 shows a schematic example of another embodiment, viewed along the machine direction. In this embodiment, the angle in the cross direction between laser line 7 and direction 70 is 90°.

Figure 7:
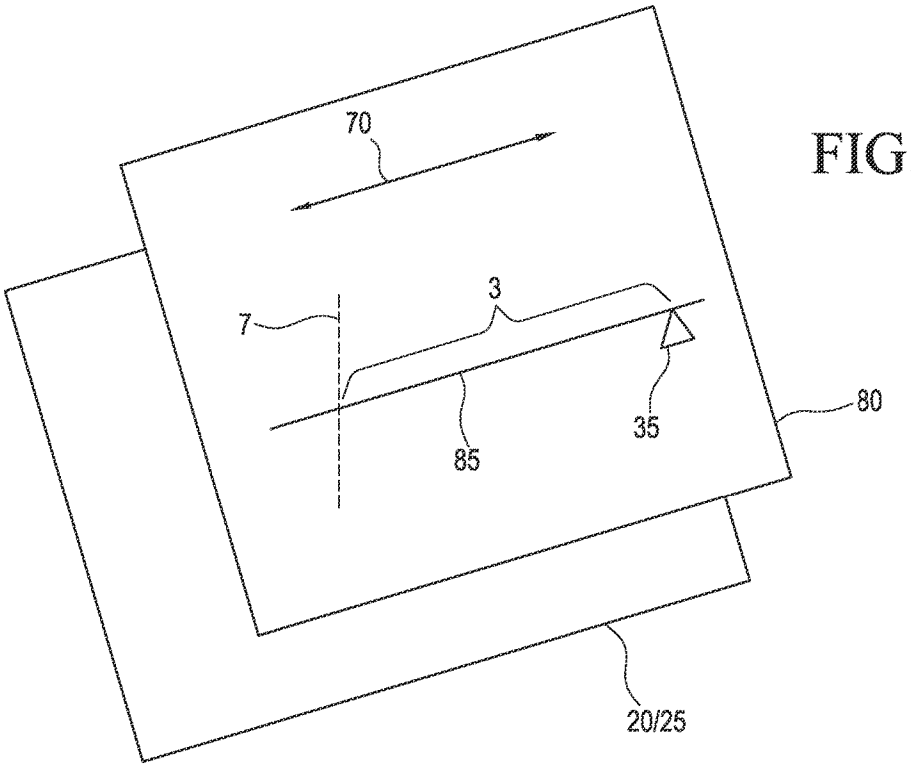
FIG. 7 shows a schematic of another embodiment, viewed in perspective.

FIG. 7 shows another embodiment, viewed in perspective. Here, the wire 20 and fiber web 25 are illustrated in planar fashion. A virtual plane 80 is also shown above and parallel to the "plane" of wire 20 and fiber web 25. A virtual line 85 is shown, which is parallel to cross direction 70 and coplanar virtual plane 80. Laser line 7 and machine reference 35 are shown. One or both of the machine reference 35 and/or bar 10 (not shown) may lie in virtual plane 80. In one embodiment laser line 7 is perpendicular to virtual plane 80 and that of wire 20 and fiber web 25. Though not shown in the figure, bar 10 can be moved along the cross direction 70 until the cut line 40 (not shown) is illuminated. The distance 3 between the cut line 40 and the machine reference 35 may then be determined.

In one embodiment, the distance 3 is measured along a virtual line 85 in a virtual plane 80 substantially parallel to the wire, fiber web, or both.

In one embodiment, the distance 3 between the cut line 40 and machine reference 35 is measured in a cross direction.

Figure 8:
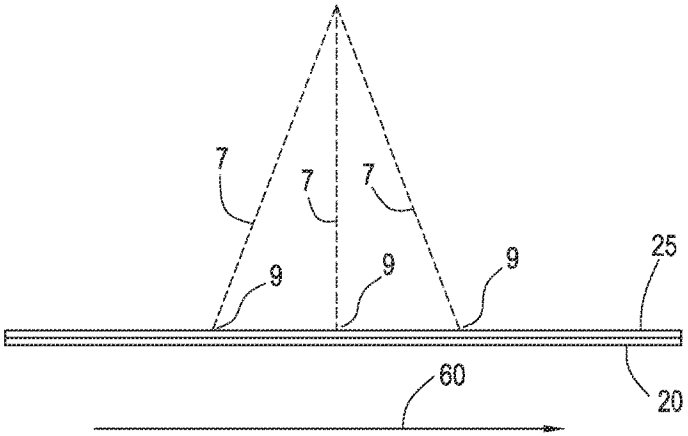
FIG. 8 shows a schematic of another embodiment, viewed along the cross direction.

FIG. 8 shows another embodiment, viewed along the cross direction 60. Wire 20 and fiber web 25 are shown. Also shown are various orientations of the laser line 7 and the resultant laser illumination mark 9. It should be understood that the angle between laser line 7 and machine direction 60 is not particularly limited—so long as the angle between laser line 7 and cross direction 70 is 90°.

Figure 9:
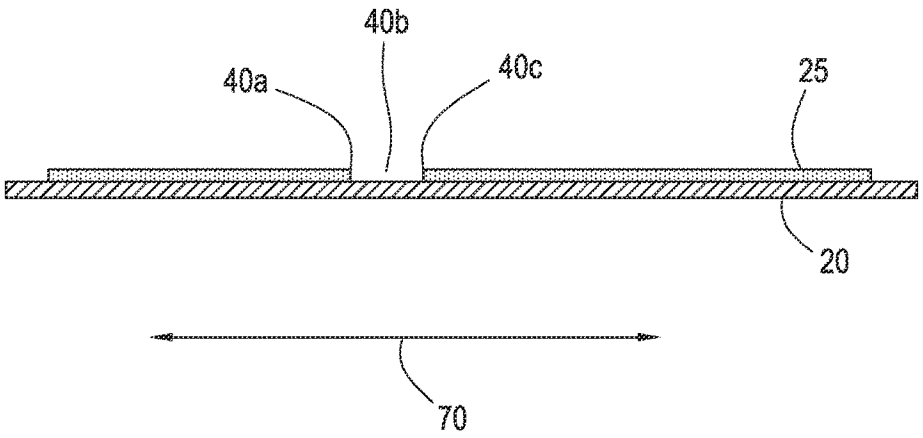
FIG. 9 shows a schematic of another embodiment, viewed along the machine direction.

FIG. 9 shows another embodiment, viewed along machine direction 60. Cross direction 70 is shown, as are the wire 20 and fiber web 25. In the figure, cut line 40 is enlarged to show edges 40*a* and 40*c* and center 40*b*. For convenience, edge 40*a* can be noted as the distal edge of cutline 40, and edge 40*c* is denoted as the machine edge. Here, the terms distal and machine may be understood in the context set out herein for bar 10. It should be understood that, depending upon the application, production requirements, type of papermaking machine, any one or all of the distal edge, 40*a*, center 40*b*, and/or machine edge 40*c* may be illuminated by laser illumination mark 9 and/or used as the location of the cut line 40 for purposes of measuring the distance 3 between cut line 40 and machine reference 35. In one embodiment, the center 40*b* or "valley" of cut line 40 is used.

Figure 10:
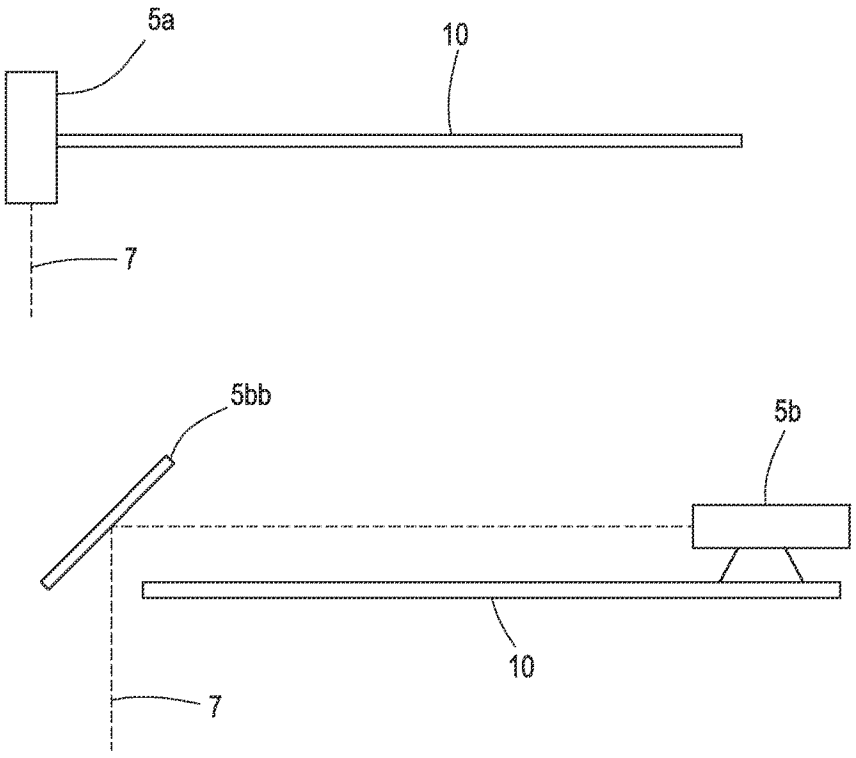
FIG. 10 shows two schematics of alternate embodiments, both viewed along the machine direction.

FIG. 10 shows two embodiments, both viewed along the machine direction 70. In the embodiment shown in the upper part of the figure, a laser 5*a* is directly attached to the distal end 10*b* of bar 10. As discussed previously, the angle between laser line 7 and bar 10, or the cross direction 70 as the case may be, is about 90°.

In the embodiment shown in the lower part of FIG. 10, the laser 5*b* is attached to or near the machine end 10*a* of bar 10, and a mirror 5*bb* is mounted at or near the distal end 10*b* of bar 10. In the figure, the mounting connection between mirror 5*bb* and bar 10 is not shown, but any suitable connection would suffice. In this embodiment, the laser line 7, generated by laser 5*b*, is directed to and reflects off of mirror 5*bb*, such that it is directed downward toward the cut line 40 (not shown).

Although two embodiments are shown in FIG. 10, they are not intended to be limiting, and other configurations may easily be contemplated.

The laser 5 is not particularly limited so long as it is suitable for illuminating and determining the cut line 40 location on the fiber web 25. Lasers are well known and many are commercially available. In one embodiment, the laser 5 may be a laser pointer or laser pen with a laser diode that emits a coherent beam of visible light. The laser 5 may be powered by batteries or other electrical connection as is known. The laser power is not particularly limiting, and may be suitably chosen based on design need, safety, and commercial availability. Laser power may suitably range from less than 1 mW to 500 mW or more, which range includes 0.1, 1, 2, 3, 4, 5, 100, 250, 500, and 1000 mW. The color is not particularly limiting so long as it is suitable for illuminating and determining the cut line 40 location on the fiber web 25. The color may be in the visible spectrum suitably chosen from red, orange, yellow, green, blue, or violet, or any combination thereof. In one embodiment, the laser 5 may emit in the infrared spectrum, which may be desirable for remote or automated detection of the laser illumination mark 9; or the laser 5 may emit a combination of infrared and visible light.

In one embodiment, the laser 5 is sufficient to project a laser illumination mark 9 onto the cut line 40 to be visible to the operator. One or more than one laser can be used.

The laser illumination mark 9 is not particularly limited, and may have a size and shape suitable to illuminate the cut line 40 and be visible to the operator. The laser illumination mark 9 may suitably be a single "dot", a series of dots, a dashed line, a solid line, a series of lines, a cross or "x", a circle, concentric circles, or combination thereof. In one embodiment, the laser illumination mark 9 is a single dot.

The size of laser illumination mark 9 is not particularly limited so long as it is sufficient to illuminate and determine the location of the cut line 40 for the measuring. In one embodiment, the laser illumination mark 9 has a size on the order of the width of the cut line 40 or smaller, but it may also be larger or have portions that are larger than the cut line 40. For example, the size may range from 1/32" to 1" across, which range includes 1/32, 1/16, 1/8, 3/16, 1/4, 5/16, 3/8, 7/16, 1/2, 5/8, 3/4, 7/8, and 1" or any combination thereof. In one embodiment, the laser illumination mark is about 1/32 to about 3/16" across.

In one embodiment, the laser illumination mark 9 has a size and/or pattern sufficient to illuminate the cut line 40 at a level of precision that is higher or the same as the level of precision permitted by a rule or tick mark 10*c* on bar 10.

Combinations of lasers with different sizes, colors, and patterns are possible.

In one embodiment, the bar 10 has rule or tick marks 10*c* with minor increments ranging from 1/32" and higher and major increments ranging from 1" and higher. These ranges include minor increments ranging of 1/32, 1/16, 1/8, 3/16, 1/4, 5/16, 3/8, 7/16, 1/2, 5/8, 3/4, and 7/8" or any combination thereof and major increments of 1, 2, 3, 4, 6, and 12" or any combination thereof.

Although inches are used herein as units of measurement, the application is not so limited, and other units of measurement such as metric or any other may be suitably used.

In one embodiment, the bar 10 is ruled such that the laser line 7 and/or laser illumination mark 9 are at the zero position at distal end 10*b*, and the rule counts up from there towards the machine end 10*a*. This embodiment may be particularly suitable when laser 5*a* or mirror 5*bb* is directly attached to the distal end 10*b* and the bar 10 is movably attached to the papermaking machine 15 at the machine end 10*a*. In this way, the measurement 3 may be read directly from the bar 10 where it lines up with the machine reference 35, for example, as shown in FIG. 1.

In another embodiment, the bar 10 is ruled such that the machine reference 35 is at the zero position, and the rule counts up from there towards the distal end 10*b*. This embodiment may be particularly suitable when laser 5*a* or mirror 5*bb* is movably attached to the distal end 10*b* and the bar 10 is fixedly attached to the papermaking machine 15 at the machine end 10*a*. In this way, the measurement 3 may be read directly from the bar 10 where it lines up with the laser 5*a*, mirror 5*bb*, or laser line 7 as appropriate.

Of course, when the bar 10 is movably attached to the papermaking machine 15 at the machine end 10*a* and the laser 5*a* or mirror 5*bb* is movably attached to the distal end 10*b*, then the measurement 3 is determined by the difference.

In one embodiment, although not shown, a camera, such as a video camera or digital camera, may be trained on the laser illumination mark 9 and cut line 40 and sent to a remote viewing device, video screen, display or similar, which may viewed by and assist the operator in illuminating the cut line 40 and determining its location for measuring, or which may be recorded, e.g, for quality control purposes, time stamping, and the like.

In one embodiment, the device 1 is adapted to project a single and suitably precise dot that is used by the operator to align with the pre-cut paper media. Once the single laser point or laser illumination mark 9 is in the "valley" of the cut-line 40 downstream of the water jet 33, the operator uses the measuring tick marks 10*c* to note the distance 3 from the laser illumination mark 9 to the machine reference 35.

In one embodiment, the laser 5 is perpendicularly mounted at the distal end 10*b* of bar 10, wherein bar 10 is a thin, flat, elongated, rectangular metal ruler. The laser 5 illuminates the cut line 40 below the ruler at a position corresponding to the zero mark of the ruler. In one embodiment, the ruler is ruled or has tick marks beginning at 0 inches (at the origin and location of the laser) and counts up in minor increments of 1/4" and major increments of 1 inch.

In some embodiments, the method may be carried out as follows: (1) illuminate the laser 5; (2) insert the measurement device 1, e.g., bar 10 and laser 5, into a mounting base on the papermaking machine; (3) slide the measurement device 1 out until the laser illumination mark 9 is positioned in the center 40*b* of the cut line 40; and (4) note to the measurement value 3 on the ruler corresponding to the machine reference 35 on the mounting base.

The measurement device 1 may be suitably affixed to the papermaking machine 15 any number of ways, which are not particularly limited. In one embodiment, a mounting base includes a suitable bracket with one or more clamps 10*d* such as shown in FIG. 1. The machine reference 35 may be incorporated into one or more of the clamps 10*d* or mounting base if desired. The mounting base may suitably provide a secure method for sliding the measurement device 1 without the risk of dropping the device onto the moving paper machine. The mounted base may also include the machine reference 35 for measuring the trim cut distance 3 for the mapping control program, and the like.

Figure 11:
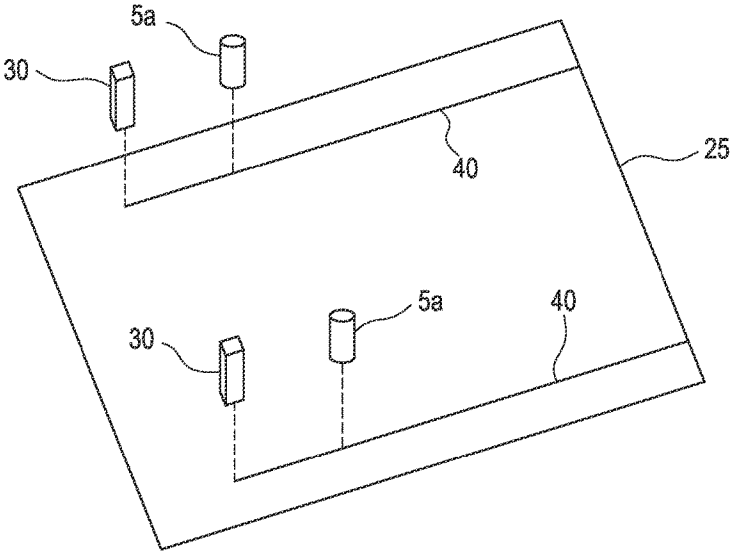
FIG. 11 shows a schematic of another embodiment, viewed in perspective.
Figure 12:
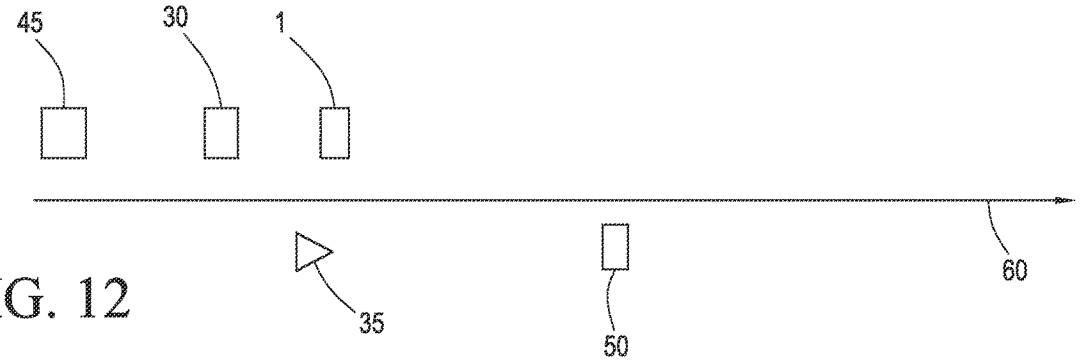
FIG. 12 shows a schematic of another embodiment, viewed along the cross direction.

FIG. 11 shows a schematic of another embodiment, viewed in perspective. Fiber web 25 is shown, with two cut lines 40 produced at different locations by trim squirts 30. Downstream of each trim squirt are lasers 5*a*. Although not shown in the figure, one or more than one machine reference 35 may be present and associated with one or both of the lasers.

In one embodiment, the paper-machine operator first adjusts the water-jet cutting device 30 according to the desired cutting position, and then uses the measurement device 1 to accurately measure the cut position (downstream from the water-jet cutting device 30) from the cut line 40 to the machine reference 35. If measurement devices are disposed on both sides of the fiber web 25, such as shown in FIG. 11, for example, the operator repeats the procedure on the opposite side of the machine. The two distance measurements 3 may then be inputted into a computer and used by the automated controls to create a virtual "map" useful for optimizing consistent paper weight quality.

In one embodiment, the accuracy of the location of the cut line 40 made in the newly formed fiber web 25 by the trim squirt 30 is not critical. However, accurately knowing the distance 3 between the cut line 40 and the machine reference 35 is very important. By resort to various embodiments described herein, an accurate measurement can be obtained of the cut position relative to a fixed reference on the papermaking machine downstream of where the water jet cut is being made.

By resort to various embodiments described herein, a control map may be obtained. In one embodiment, a control map is a two dimensional map that associates each headbox dilution actuator with the affected (i.e., impacted, dependent) product measurement zone(s) at the product measurement scanner (or analyzer). The boundaries of the control map are the near and far side ends of the headbox, the near and far side trim squirt positions, and the near and far side edges of the paper web as it passes through the product measurement scanner (or analyzer). The control map can be determined by keeping all dilution actuators at a constant position and modifying the control output to a few actuators (to open or close them more than previously). These actuators are selected at positions spaced out across the cross direction. The product weight scanner measures the product weight and generates a cross direction weight profile. The cross direction weight profile will show the product measurement zones impacted by each modified actuator. Based on the association between the modified actuators and impacted product measurement zones, a control map program can then generate a map that associates some or all of the dilution actuators with their corresponding product measurement zone(s).

In one embodiment, the order of operational components in the papermaking machine 15 along machine direction 60 are as follows: headbox 45, produces fiber web 25 (not shown), which is cut by trim squirt 30 to produce a cut line 40 (not shown) in the paper web 25. Measurement device 1 and machine reference 35 appear downstream of the trim squirt 30; and further downstream operations include product weight scanner 50 and (although not shown) pressing, drying, coating, calendaring, cutting, collecting, and/or converting as appropriate.

In one embodiment, the headbox 45 deposits a papermaking furnish on a wire 20 to form a fiber web 25. The furnish and/or fiber web 25 are not particularly limiting. For example, the furnish and/or web may contain a cellulose pulp, water, binder, optional known papermaking components, or combination thereof, as known in the art.

Figure 13:
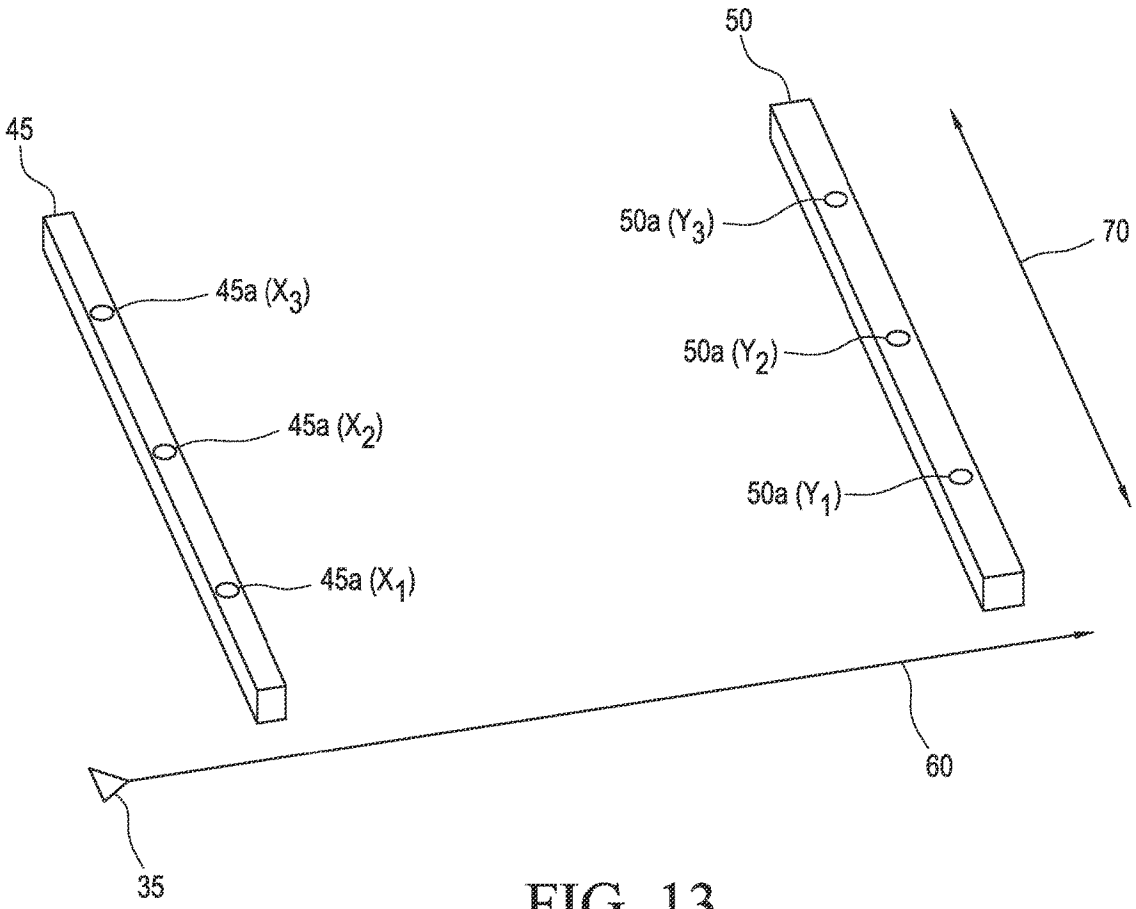
FIG. 13 shows a schematic of another embodiment, viewed in perspective.

FIG. 13 shows a schematic of another embodiment, viewed in perspective. Shown are machine reference 35, machine direction 60, and cross direction 70. Also shown are hydraulic headbox 45 and product weight scanner 50. A plurality of headbox actuators 45*a* and corresponding weight measurement zones 50*a* are shown. In one embodiment, elements $X_{1, 2, 3} \ldots$ and $Y_{1, 2, 3} \ldots$ represent the respective distances of actuators and weight measurement zones, 45*a*$_{1, 2, 3} \ldots$ and 50*a*$_{1, 2, 3} \ldots$ along the cross direction 70 from machine reference 35. In another embodiment, elements $X_{1, 2, 3} \ldots$ and $Y_{1, 2, 3} \ldots$ represent the corresponding headbox actuators 45*a* and weight measurement zones 50*a* (e.g., $Y_1$ corresponds to or is affected by $X_1$, $Y_2$ corresponds to or is affected by $X_2$, etc.).

One or more than one headbox actuator 45*a* can correspond with one or more than one weight measurement zone 50*a*, as is known in the art. For example, the ratio of the number of headbox actuators 45*a* to weight measurement zones 50*a* can range from 1:1 to 1:15. These ranges include all values and subranges therebetween, including 1:1, 1:2, 1:3, 1:4, 1:5, 1:6, 1:7, 1:8, 1:9, 1:10, 1:11, 1:12, 1:13, 1:14, and 1:15. In one embodiment, the number of headbox actuators 45*a* is the same as or less than the number of weight measurement zones 50*a*. In some embodiments, the number of headbox actuators 45*a* is less than the number of weight measurement zones 50*a*. For example, a papermaking machine may have 100 headbox actuators 45*a* and 300, 600, 1000, 1200 or more weight measurement zones 50*a*.

Figure 14:
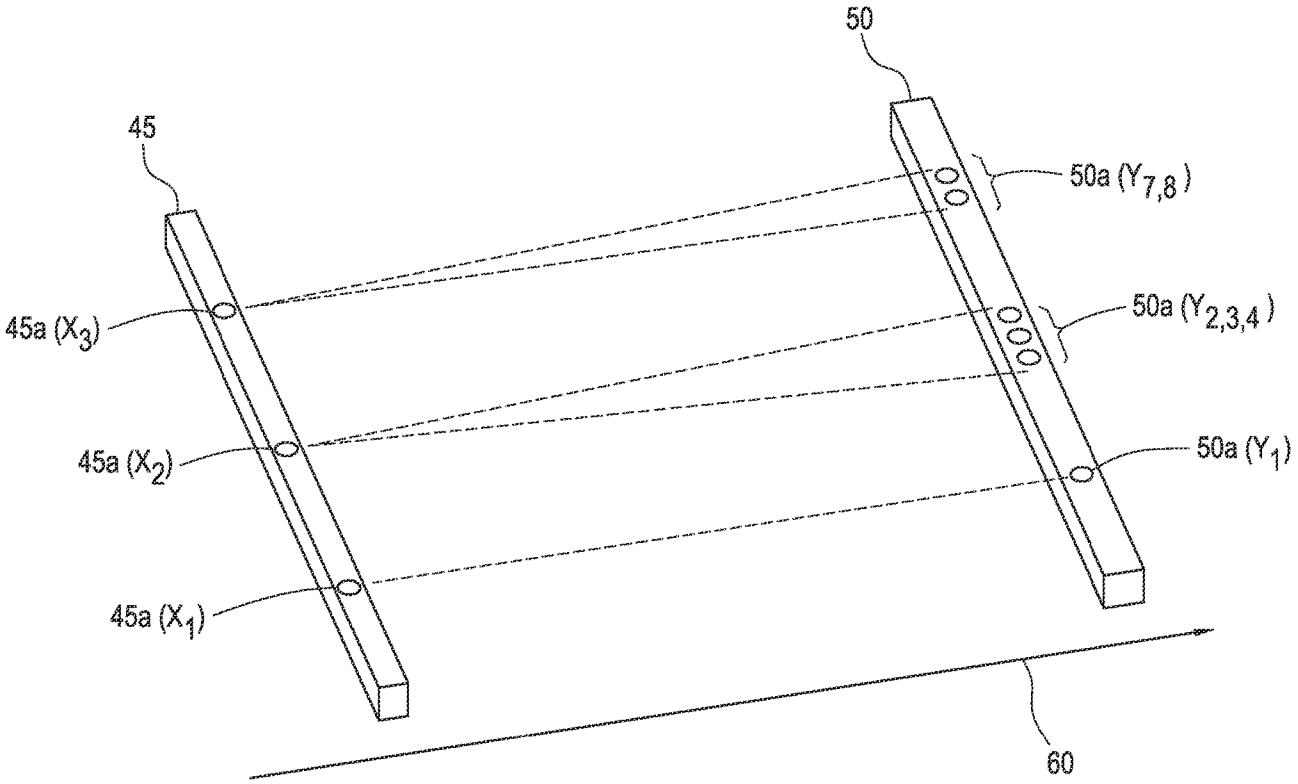
FIG. 14 shows a schematic of another embodiment, viewed in perspective.

FIG. 14 shows a schematic of an embodiment in which one or more than one of the weight measurement zones 50*a* correspond to or are affected by one headbox actuator 45*a* (the paper web 25 is not shown). In one embodiment, the elements X and Y represent the corresponding headbox actuators 45*a* and weight measurement zones 50*a* (e.g., $Y_1$ corresponds to or is affected by $X_1$, $Y_2$ corresponds to or is affected by $X_2$, etc.). In one embodiment, seen in FIG. 14, each headbox actuator 45*a* (elements $X_{1, 2, 3}$) corresponds to different weight measurement zones 50*a* either singularly (element $Y_1$) or in various groups (elements $Y_{2, 3, 4}$ and $Y_{7, 8}$). In some embodiments, the measurements obtained from a group of adjoining weight measurement zones are combined, and the median or mean values of that group of zones are calculated. In some embodiments, the median or mean value thus obtained represents the weight measurement of a particular section of the web that corresponds to or is affected by a corresponding headbox actuator. In some embodiments, a mean value is used. In other embodiments, a median value is used.

In one embodiment, each of the headbox actuators 45*a*$_{1, 2, 3} \ldots$ deposits a portion of papermaking furnish on wire 20, which portions, taken together, can form the fiber web 25. By controlling the headbox actuators 45*a*, one or more of the volume, density, viscosity, consistency, etc. of the papermaking furnish deposited by the actuators on the wire 20 can be increased or decreased. The output of one or more of the headbox actuators 45*a*, e.g., the volume, density, viscosity, consistency, etc. of the furnish deposited by the actuators, may be independently controlled, if desired.

Because they are part of the papermaking machine, the cross-directional positions of actuators 45*a* and weight measurement zones 50*a* are fixed relative to one another and to the machine reference 35. For reasons already discussed, however, because of the variability in the cross-directional position of the cut line 40, both real and measured, the relative position of the cut line 40 to the actuators 45*a* and weight measurement zones 50*a* along the cross direction is similarly variable, and this can lead to significant errors in coordinating the operation of corresponding actuators.

Variability can also arise from shrinkage or widening of the fiber web 25, sideways translation of the fiber web 25, or both during operation. For example, as the fiber web 25 dries while being conveyed in the machine direction 60 along the wire 20, it can shrink, i.e., become narrower along the cross-direction 70 during operation. The fiber web 25 can also become wider on one side or the other or both sides as it settles onto the wire 20. The cross-directional position of the fiber web 25 as it is conveyed along the wire 20 can change relative to the machine reference 35 due to a variety of factors, e.g., a bias, non-uniformity, dimple, or other artifact in the wire 20. By resort to various embodiments described herein, the disadvantageous effects on paper quality arising from these variabilities can be minimized or even eliminated. For example, in a 220" wide paper web, the shrinkage can be as much as 16" depending on sheet weight. Examples of such variability are shown schematically in FIG. 15.

Figure 15:
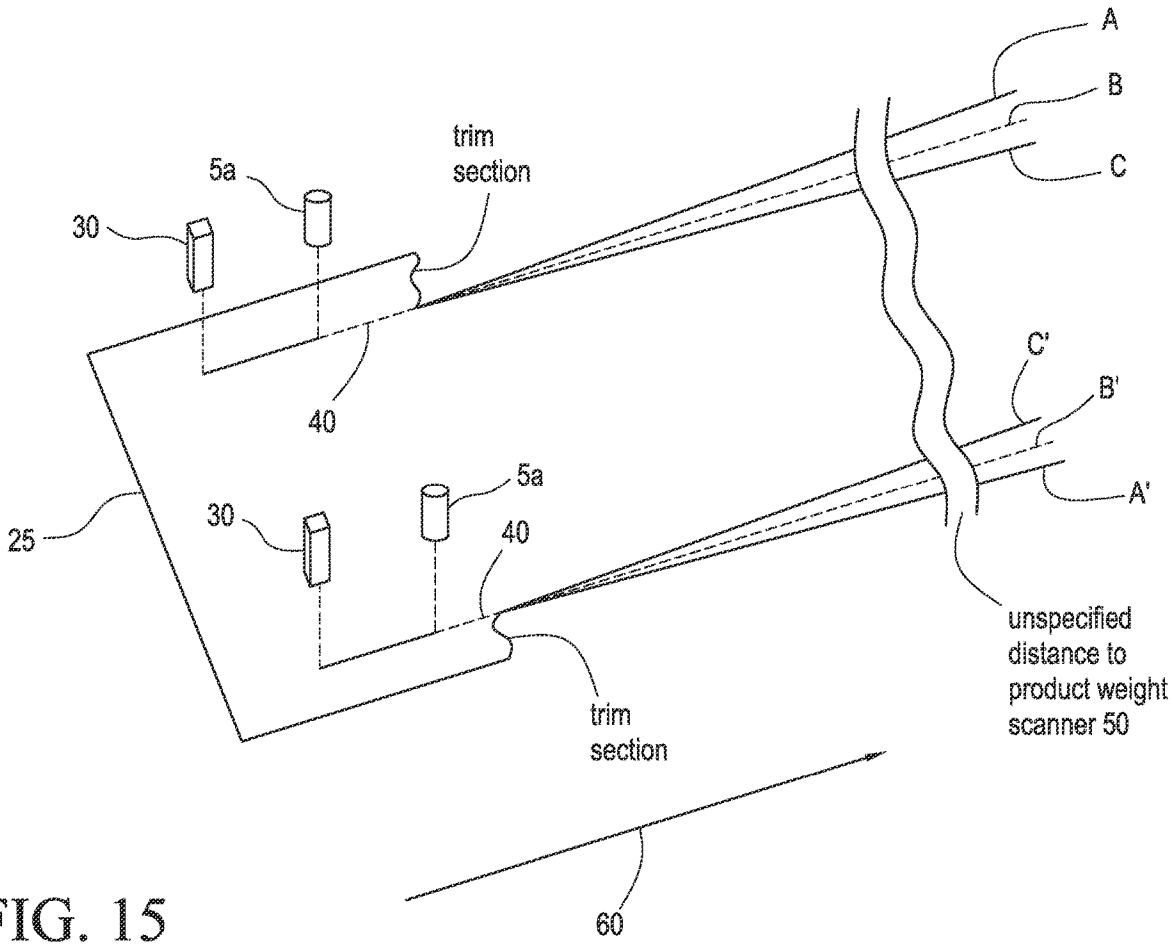
FIG. 15 shows a schematic of another embodiment, viewed in perspective.

In FIG. 15, paper web 25, machine direction 60, trim squirts 30, and lasers 5*a* are shown. Between the laser 5*a* and the product weight scanner 50 (not shown), an unspecified distance is also shown. In one embodiment, in the absence of variability, the cut lines 40 on each side of the paper web 25 are shown by dotted lines B and B'. In another embodiment, if the paper web 25 shrinks before reaching the product weight scanner 50, the cut lines 40 may deviate toward the center of the paper web 25 as lines C and C'. In another embodiment, if the paper web 25 expands before reaching the product weight scanner 50, the deviation of cut lines 40 are shown by lines A and A'. In another embodiment, if the paper web 25 moves along the cross direction before reaching the product weight scanner 50, the result may be cut lines A and C' or C and A' as the case may be.

In one embodiment, a control loop is contemplated, wherein the measurement distance 3 is used for coordinating or adjusting one or more control output to control one or more of volume, density, viscosity, consistency, etc., or any combination thereof of one or more of the headbox actuators 45*a*. In another embodiment, the control loop also includes coordinating one or more measurements obtained from one or more of the weight measurement zones 50*a*. In another embodiment, a control loop is contemplated, wherein the measurement distance 3 is used for coordinating or adjusting one or more of an output to control one or more of a volume, density, viscosity, consistency, etc., or any combination thereof based on one or more measurements obtained from one or more of the corresponding weight measurement zones 50*a*. The control loop may be automated, for example, by a computer, controller, programmable logic controller, or other central processing unit.

In addition or alternatively, although weight measurement zones are described herein, other measurement zones may be used. For example moisture, caliper, density, and others may be measured and mapped.

In one embodiment, a control output is an adjustment the controller makes to affect the attached actuator. For example, if a particular controller responsible for dilution in a corresponding actuator has an output of 50% to the actuator, and it is determined that more dilution is needed in that actuator, then the controller can increase the "dilution" output signal to the actuator to 51% . . . then 52% etc until the actuator achieves the intended target, i.e., the furnish produced by that actuator is at the target dilution level.

By resort to various embodiments described herein, the cross-directional positions of each actuator 45*a*, measurement zone 50*a*, or both can be accurately and reproducibly determined relative to the cut line 40. Similarly, by resort to various embodiments described herein, one can readily determine which measurement zone or group of zones correspond to or are affected by the actuator or actuators.

The fiber web 25 can have any width in the cross direction 70. The width is not particularly limited, and it may suitably range from 3" to 500". This range includes all values and subranges therebetween, including, for example, 3, 4, 5, 6, 7, 8, 9, 10, 11, 12, 24, 36, 72, 99, 101, 102, 104, 108, 109, 110, 120, 122, 135, 139, 144, 160, 180, 185, 200, 212, 213, 214, 215, 216, 220, 226, 240, 252, 272, 290, 300, 329, 347, 350, 400, 420, 440, 450, 465, 480, 490, and 500", or any combination thereof.

In one embodiment, the accuracy of the cut line 40 can be determined to within 2% or less, depending on the width of the fiber web 25. This range includes all values and subranges therebetween, including, for example, 0.01, 0.02, 0.03, 0.04, 0.05, 0.06, 0.07, 0.08, 0.09, 0.1, 0.2, 0.3, 0.4, 0.5, 0.6, 0.7, 0.8, 0.9, 1.0, 1, 1.1, 1.2, 1.3, 1.4, 1.5, 1.6, 1.7, 1.8, 1.9, 2.0, and 2%, or any combination thereof.

In one embodiment, the location of cut line 40 may be measured to within 1/32". This range includes all values and subranges therebetween, including, for example 1/32, 1/16, 1/8, 3/16, 1/4, 5/16, 3/8, 7/16, 1/2, 5/8, 3/4, and 7/8" or any combination thereof as appropriate. In one embodiment, the location of cut line 40 is accurately measured to within 1/8" over a fiber web 25 having a cross direction width 214".

Figure 16:
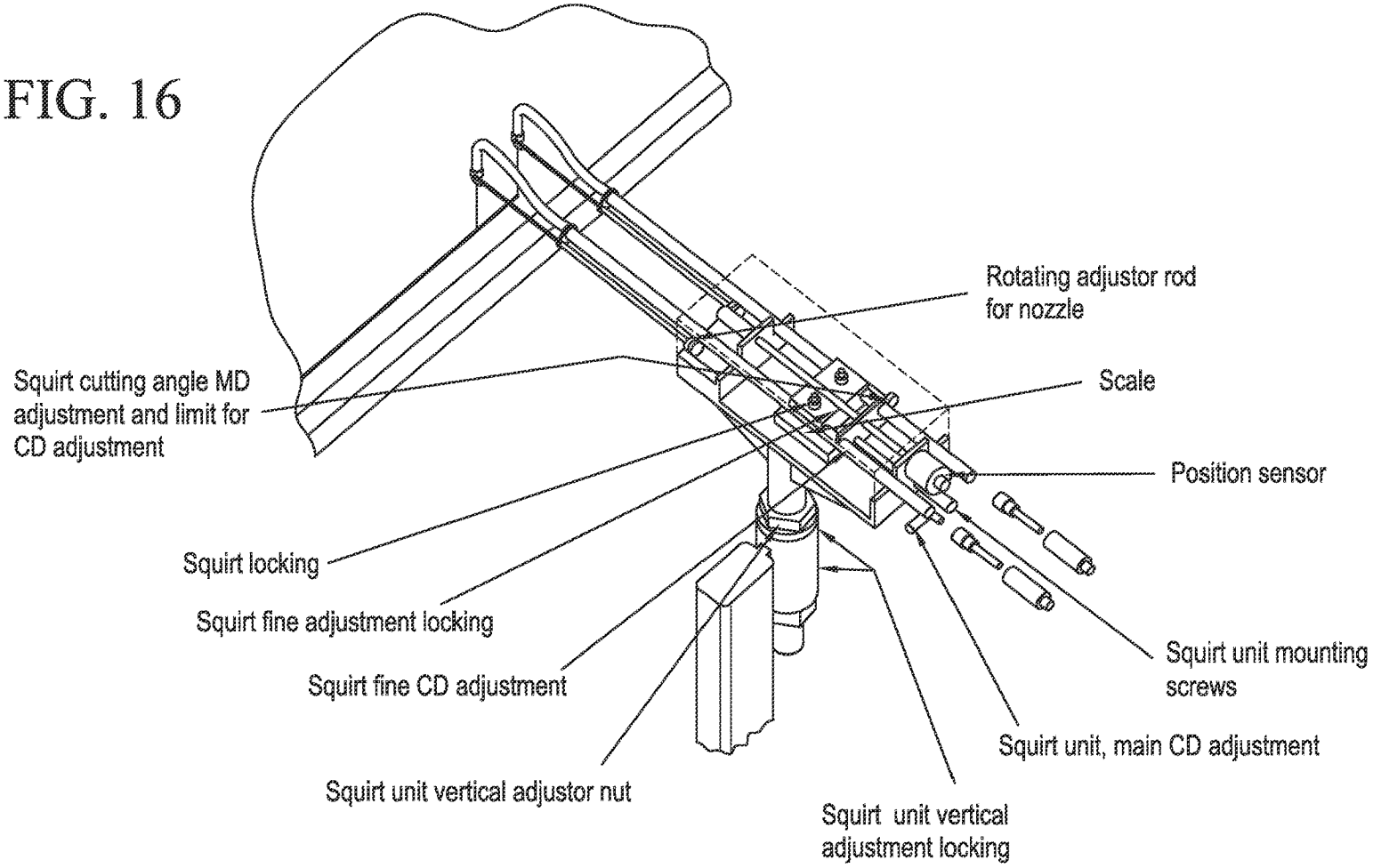
FIG. 16 shows one example of a commercially available trim squirt device.

FIG. 16 shows one example of a commercially available trim squirt device. Shown are a squirt cutting angle MD adjustment and limited for CD adjustment; squirt locking; squirt fine adjustment locking; squirt fine CD adjustment; squirt unit vertical adjuster nut; squirt unit vertical adjustment locking; squirt unit, main CD adjustment; squirt unit mounting screws; position sensor; scale; and rotating adjuster rod for nozzle.

While not required, various adjustments and designs of commercially available trim squirt devices may optionally include adjustments for external trim squirt positioning, e.g. adjust cross machine direction outside the wire area and adjust nozzle angle outside the wire area; and/or micro-adjust trim squirt swivel for easy alignment when using double nozzles. Optional design features may include removable trim squirt pipe assemblies, quick removal of trim squirt pipe assemblies, or positive stop on assembly to remember the position of pipe assembly; tapered drip cone so build up on nozzle drains off to trim side; external filters that can be replaced without disturbing the location of nozzle; and trim squirt position indicators, e.g., scales mounted on each side showing position of trim squirt.

Various other embodiments, which are not intended to be limiting, are described below.

A. One embodiment provides a papermaking machine, comprising:

a wire for conveying a fiber web;

a trim squirt for making a cut line in the fiber web;

a machine reference; and a measurement device for measuring a distance between the cut line and the machine reference, the device comprising a laser adapted to illuminate the cut line and determine a location of the cut line for the measuring.

B. Another embodiment provides a papermaking machine of embodiment A, wherein the measurement device further comprises a ruled bar having a machine end and a distal end opposite the machine end, the machine end being moveably attached to the papermaking machine, and the laser being fixedly attached to the distal end.

C. Another embodiment provides a papermaking machine of embodiment A, wherein the measurement device further comprises a bar having a machine end and a distal end opposite the machine end, the machine end being fixedly or moveably attached to the papermaking machine, and the laser being fixedly or moveably attached to the distal end.

D. Another embodiment provides a papermaking machine of embodiment C, wherein the machine end is moveably attached to the papermaking machine, and the laser is fixedly attached to the distal end.

E. Another embodiment provides a papermaking machine of embodiment C, wherein the bar is a ruled bar.

F. Another embodiment provides a papermaking machine of embodiment C, wherein the bar is selected from the group consisting of a ruled bar, unruled bar, electromagnetically operated piston bar, hydraulically operated piston bar, mechanically operated piston bar, threaded bar, clamped bar, or combination of two or more thereof.

G. Another embodiment provides a papermaking machine of embodiment C, wherein the laser is adapted to illuminate the cut line at an angle of about 90 degrees relative to the bar.

H. Another embodiment provides a papermaking machine of embodiment A, wherein the laser is adapted to illuminate the cut line at an angle of about 90 degrees relative to a cross direction.

I. Another embodiment provides a papermaking machine of embodiment A, wherein the distance is measured along a virtual line in a virtual plane substantially parallel to the wire, fiber web, or both.

J. Another embodiment provides a papermaking machine of embodiment A, wherein the distance is measured in a cross direction.

K. Another embodiment provides a papermaking machine of embodiment A, further comprising a hydraulic headbox having a plurality of actuators.

L. Another embodiment provides a papermaking machine of embodiment K, wherein the actuators are dilution actuators.

M. Another embodiment provides a papermaking machine of embodiment A, further comprising a hydraulic headbox having a plurality of actuators, wherein an output of one or more of said actuators is a function of said distance.

N. Another embodiment provides a papermaking machine of embodiment A, comprising more than one measurement device and more than one trim squirt.

O. Another embodiment provides a papermaking machine of embodiment A, comprising more than one measurement device and more than one machine reference.

P. Another embodiment provides a method for making a fiber web, comprising:

conveying a fiber web on a wire of a papermaking machine, the papermaking machine comprising a trim squirt and a machine reference;

making a cut line in the fiber web with the trim squirt;

illuminating the cut line and determining a location of the cut line with a laser; and using the location, measuring a distance between the cut line and the machine reference.

Q. Another embodiment provides a method of embodiment P, wherein the papermaking machine further comprises a hydraulic headbox having a plurality of actuators, further comprising adjusting an output one or more of said actuators using said distance.

R. Another embodiment provides a method of embodiment P, further comprising one or more of pressing, drying, coating, calendering, or cutting all or a portion of the fiber web.

S. Another embodiment provides a method of embodiment P, further comprising collecting all or a portion of the fiber web on a reel.

T. Another embodiment provides a method of embodiment P, further comprising converting the fiber web into a paper product.

U. Another embodiment provides a fiber web, produced by the method of embodiment P.

V. Another embodiment provides a paper product, produced by the method of claim U.

W. Another embodiment provides a method for making the papermaking machine of embodiment A, comprising:

affixing the measurement device to the papermaking machine.

X. Another embodiment provides a papermaking machine of embodiment A, further comprising a hydraulic headbox having a plurality of actuators, wherein a control output to one or more of said actuators is a function of said distance.

Y. Another embodiment provides a method of embodiment P, wherein the papermaking machine further comprises a hydraulic headbox having a plurality of actuators, further comprising adjusting a control output to one or more of said actuators using the control map created or influenced by said distance.

The invention claimed is:

1. A papermaking machine, comprising:

a wire for conveying a fiber web;

a trim squirt for making a cut line in the fiber web;

a machine reference for providing a fixed reference point on the papermaking machine; and a measurement device for measuring a distance in the cross machine direction between the cut line and a point aligned in the cross machine direction with the machine reference, the device comprising a laser adapted to illuminate the cut line and determine a location of the cut line for the measuring.

2. The papermaking machine of claim 1, wherein the measurement device further comprises a ruled bar having a machine end and a distal end opposite the machine end, the machine end being moveably attached to the papermaking machine to allow the ruled bar to move in the cross machine direction to allow the laser to illuminate the cut line, and the laser being fixedly attached to the distal end.

3. The papermaking machine of claim 1, wherein the measurement device further comprises a bar having a machine end and a distal end opposite the machine end, the machine end being fixedly or moveably attached to the papermaking machine to allow the bar to move in the cross machine direction and to allow the laser to illuminate the cut line, and the laser being fixedly or moveably attached to the distal end to allow the laser to move along the bar in the cross machine direction to allow the laser to illuminate the cut line.

4. The papermaking machine of claim 3, wherein the machine end is moveably attached to the papermaking machine, and the laser is fixedly attached to the distal end.

5. The papermaking machine of claim 3, wherein the bar is a ruled bar.

6. The papermaking machine of claim 3, wherein the bar is selected from the group consisting of a ruled bar, unruled bar, electromagnetically operated piston bar, hydraulically operated piston bar, electromechanically operated bar, mechanically operated piston bar, threaded bar, clamped bar, or combination of two or more thereof.

7. The papermaking machine of claim 1, wherein the laser is adapted at an angle of about 90 degrees relative to the bar to illuminate the cut line.

8. The papermaking machine of claim 1, wherein the laser is adapted at an angle of about 90 degrees relative to a cross direction to illuminate the cut line.

9. The papermaking machine of claim 1, wherein the distance is measured along a virtual line in a virtual plane substantially parallel to the wire, fiber web, or both.

10. The papermaking machine of claim 1, further comprising a hydraulic headbox having a plurality of actuators.

11. The papermaking machine of claim 10, wherein the actuators are dilution actuators.

12. The papermaking machine of claim 1, further comprising a hydraulic headbox having a plurality of dilution actuators, wherein an output of one or more of said dilution actuators is a function of said distance.

13. The papermaking machine of claim 1, comprising more than one measurement device and more than one trim squirt.

14. The papermaking machine of claim 1, comprising more than one measurement device and more than one machine reference.

15. The papermaking machine of claim 1, further comprising a hydraulic headbox having a plurality of dilution actuators, wherein a control output to one or more of said dilution actuators is a function of said distance.

16. A method for making the papermaking machine of claim 1, comprising:

affixing the measurement device to the papermaking machine.

* * * * *